US007200978B1

(12) United States Patent
Focke et al.

(10) Patent No.: US 7,200,978 B1
(45) Date of Patent: Apr. 10, 2007

(54) PROCESS FOR PRODUCING HINGE-LID BOXES FOR CIGARETTES

(75) Inventors: Heinz Focke, Verden (DE); Martin Stiller, Verden (DE)

(73) Assignee: Focke & Co. (GmbH & Co.) (DE)

( * ) Notice: Subject to any disclaimer, the term of this patent is extended or adjusted under 35 U.S.C. 154(b) by 0 days.

(21) Appl. No.: 09/724,016

(22) Filed: Nov. 28, 2000

(30) Foreign Application Priority Data

Nov. 29, 1999 (DE) ..... 199 57 415

(51) Int. Cl.
*B65B 58/00* (2006.01)

(52) U.S. Cl. ..... 53/441; 53/466; 53/225; 493/156; 493/157

(58) Field of Classification Search ..... 493/156, 493/157, 150, 151, 162, 441, 412, 463, 176, 493/329; 53/441, 412, 463, 176, 329, 466, 53/225

See application file for complete search history.

(56) References Cited

U.S. PATENT DOCUMENTS

| | | | | |
|---|---|---|---|---|
| 3,924,386 | A * | 12/1975 | Schmermund | |
| 4,036,117 | A * | 7/1977 | Davies et al. | 493/169 |
| 4,092,816 | A * | 6/1978 | Seragnoli | |
| 4,208,854 | A * | 6/1980 | Seragnoli | |
| 4,256,526 | A * | 3/1981 | McDaniel | |
| 4,330,977 | A * | 5/1982 | Focke | 53/371.7 |
| 5,766,121 | A * | 6/1998 | Spada | 493/150 |
| 5,899,048 | A * | 5/1999 | Havens et al. | |
| 6,223,506 | B1 * | 5/2001 | Ghini et al. | 53/463 |

FOREIGN PATENT DOCUMENTS

| | | | |
|---|---|---|---|
| CN | 1146415 | A | 4/1997 |
| DE | 36 38 627 | A1 | 5/1988 |
| DE | 37 18 702 | A1 | 12/1988 |
| DE | 38 24 924 | A1 | 1/1990 |
| EP | 0 433 761 | A1 | 7/1991 |
| EP | 0 756 993 | A1 | 2/1997 |
| GB | 600377 | | 10/1945 |
| GB | 2179018 | A | 2/1987 |
| WO | WO 9856662 | A | 12/1998 |

OTHER PUBLICATIONS

Torta Research S.r.l., European Patent Office.
Chinese Office Action (with English translation), dated Mar. 26, 2004.

* cited by examiner

*Primary Examiner*—Sameh H. Tawfik
(74) *Attorney, Agent, or Firm*—Thomas, Kayden, Horstemeyer & Risley LLP; Todd Deveau

(57) ABSTRACT

Process for producing packs made of thin cardboard with an outer wrapper made of shrink-wrap film. Folding tabs of the outer wrapper are connected to one another by full-surface-area heat sealing. The shrink-wrapping process for the outer wrapper may be initiated as a result. In order to ensure a correct form of the outer wrapper, the folding tabs, prior to the full-surface-area sealing operation, are connected to one another by a tack seal, with small, limited sealing surface areas, and are then sealed over the full surface area.

10 Claims, 4 Drawing Sheets

10
11
12
13
14
15
16
17
18
19
20
21
22
23
24
25
26
27
28
29
30

PROCESS FOR PRODUCING HINGE-LID BOXES FOR CIGARETTES

FIELD OF THE INVENTION

The invention relates to a process for producing (dimensionally stable) packs made of (thin) cardboard with an outer wrapper made of thin film, in particular a hinge-lid box for cigarettes. The invention also relates to an apparatus for producing such packs and/or for carrying out the process.

BACKGROUND OF THE INVENTION

It is common in packaging technology to provide dimensionally stable packs, consisting in particular of cardboard, with an outer wrapper made of thin, transparent film. Such an outer wrapper is common in cigarette packs of the hinge-lid type. Before the pack is opened for the first time, the outer wrapper, which is usually provided with a tear-open strip, is removed.

SUMMARY OF THE INVENTION

The invention concerns measures for the improved production of such packs, in particular hinge-lid packs for cigarettes. The object of the invention is to ensure an improved, particularly fold-free, appearance of the outer wrapper by virtue of the film being shrunk.

In order to achieve this object, the process according to the invention is characterized by the following features:

a) the outer wrapper consists of a shrink-wrapping film, b) the pack provided with the outer wrapper is subjected to a shrink wrapping and/or heat treatment, c) prior to the shrink-wrapping treatment, folding tabs of the outer wrapper are connected to one another by large-surface-area heat sealing, and, prior to the heat sealing operation, the folding tabs are (temporarily) fixed in their folding position by tacking.

The invention is based on the finding that, upon initiation of the shrink-wrapping and/or heat treatment, the outer wrapper has to be completely finished; in other words all the folding tabs have to be folded into the correct position and fixed in said position. In order to connect the folding tabs to one another, particularly in the region of the end wall, base wall and side wall, use is made of large-surface-area sealing elements which subject the folding tabs to the action of heat, usually over a large surface area and/or over the entire surface area of the pack, in order to bring about heat sealing of the folding tabs. The shrink-wrapping process of the outer wrapper is initiated in this case. This results, in particular, with sealing steps which follow one after the other in time of space, in undesired, permanent deformations of the outer wrapper. In the invention, as a result of the preliminary sealing and/or preliminary tacking, fixing of the outer wrapper in the correct folding position is completed without a shrink-wrapping treatment being initiated by said tacking and/or preliminary sealing. It is then possible for the pack to be subjected directly to a shrink-wrapping treatment or to be sealed over a large surface area in the region of the folding tabs in the conventional manner.

The apparatus according to the invention, as part of a packing machine, is designed such that tacking elements are arranged upstream of a sealing station and/or sealing sub-assemblies, for the folding tabs, which tacking elements bring about tacking and/or preliminary sealing of the folded outer wrapper in the region of the folding tabs.

BRIEF DESCRIPTION OF THE DRAWINGS

Further details of the invention are explained in more detail below with reference to exemplary embodiments of the pack according to the invention and of an apparatus. In the drawings.

DETAILED DESCRIPTION OF A PREFERRED EMBODIMENT

Figure 1:
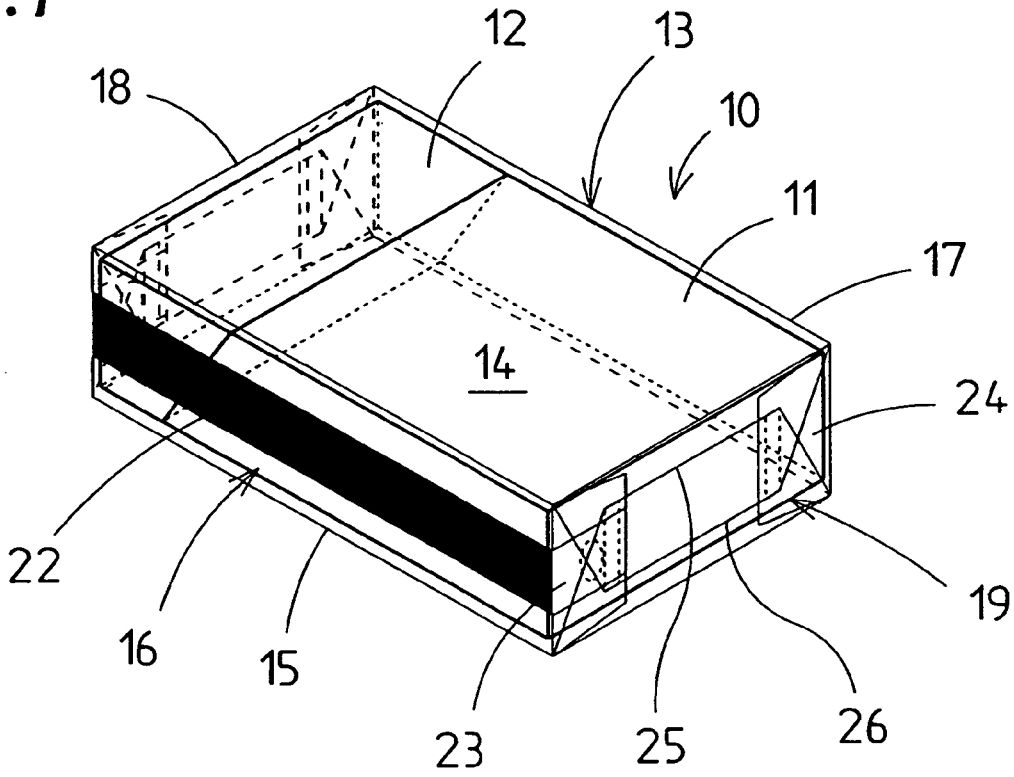
FIG. 1 shows a pack, namely a hinge-lid box with ready sealed side tabs.

The drawings concern a cubical pack 10 of the hinge-lid-box type for cigarettes. The pack 10 comprises a blank of thin cardboard. In accordance with the conventional construction, the pack comprises a box part 11 and a lid 12.

The pack 10 is enclosed by an outer wrapper 13 made of thin film, to be precise a shrink-wrapping film. The outer wrapper 13 forms, in accordance with the configuration of the pack 10, large-surface-area walls, namely a front wall 14 and rear wall 15, narrow, elongate side walls 16 and 17 and an end wall 18 and base wall 19.

Figures 3, 4, 5:
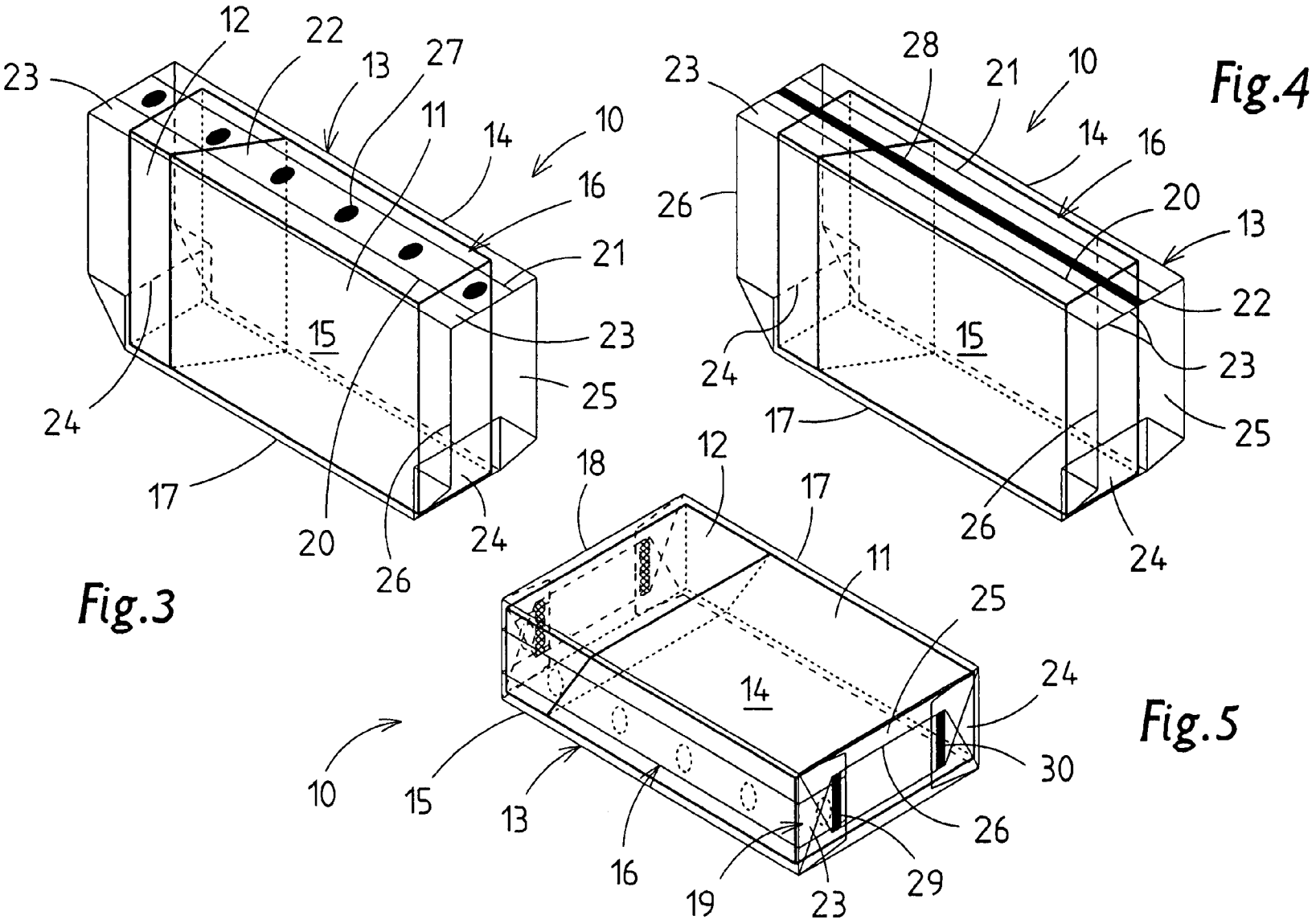
FIG. 3 shows the pack with partially folded outer wrapper and tacked side tabs.
FIG. 4 shows an illustration corresponding to FIG. 3 with likewise tacked side tabs.
FIG. 5 shows the pack according to FIG. 3 with tacked end tabs and base tabs.

The outer wrapper 13 forms folding tabs which are connected to one another by heat sealing. In the region of the side wall 16, side tabs 20 and 21 of the blank of the outer wrapper 13 form a strip-like overlap 22. The latter extends over the entire length of the outer wrapper 13 (FIGS. 3 and 4). The side tabs 20, 21 are connected to one another by sealing in the region of the overlap 22, to be precise over the entire surface area of the overlap 22, as is illustrated in FIG. 1 by the blackened sealing surface areas.

Figure 2:
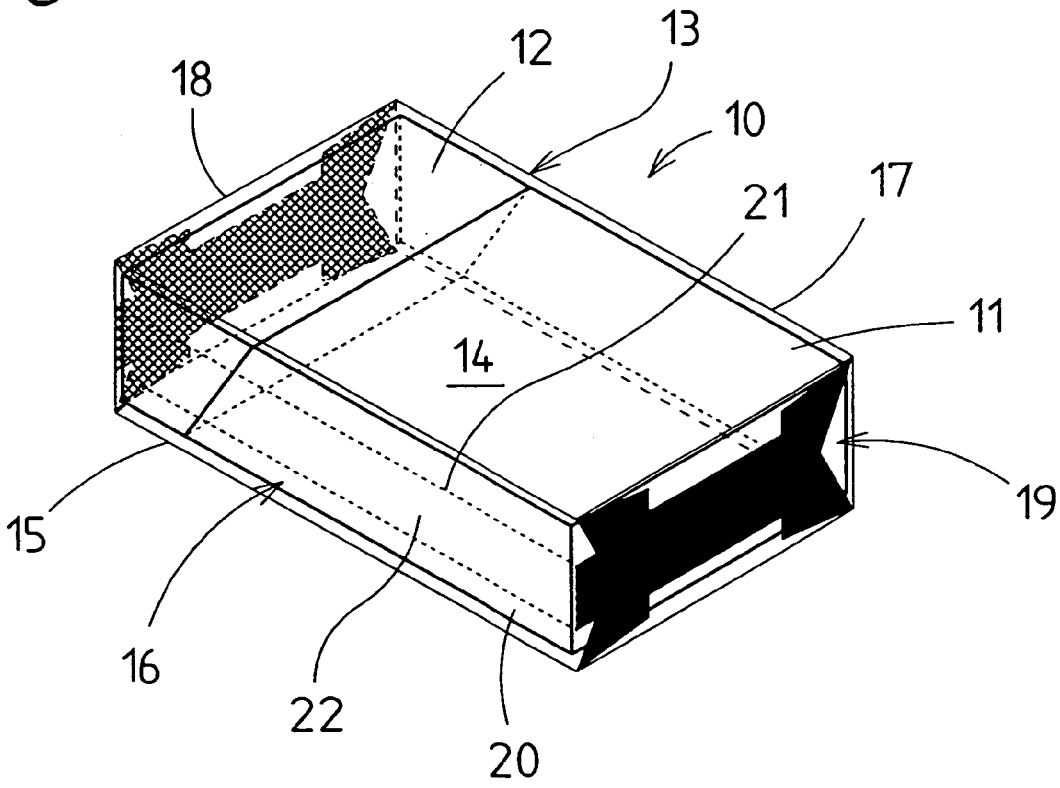
FIG. 2 shows the hinge-lid box according to FIG. 1 with ready sealed end tabs and base tabs.

The end wall 18 and base wall 19 likewise comprise folding tabs, to be precise inner transverse tabs 23, 24 and outer, trapezoidal longitudinal tabs 25, 26. The tabs 23, 24, 25, 26 partially overlap one another. In FIG. 2, the overlap region, and thus the region of the tabs 23, 24, 25, 26 which are connected to one another by sealing, is illustrated as a blackened and/or hatched surface area.

Providing the large-surface-area seals in the area of the overlap 22 and of the base wall 19 brings about at least the initiation of the shrink-wrapping process as far as the outer wrapper 13 is concerned. This is disadvantageous, in particular, when the operations of sealing the overlap 22, on the one hand, and sealing the end wall 18 and base wall 19, on the other hand, are carried out in successive steps.

In order to ensure a precise form and position of the outer wrapper 13 despite successive sealing steps, the folding tabs are connected to one another by tacking in preceding steps, the operation of providing the tacking being associated with a small and/or locally limited supply of heat.

First of all, on account of the sequence of folding steps, tacking is provided in the region of the overlap 22 of the side tabs 20, 21. In the exemplary embodiment of FIG. 3, said tacking comprises small-surface-area spot seals 27. A plurality of circular or oval spot seals 27 are provided along the (non-folded) overlap 22 in a spaced apart manner. At least in each case one spot seal 27 is located in the region of those regions of the outer wrapper which project beyond the pack 10 and are intended for forming the transverse tabs 23.

An alternative is shown in FIG. 4 by a sealing strip 28 which extends over the entire length of the blank and/or of the (non-folded) overlap 22. Said sealing strip is of comparatively narrow width, for example approximately 2 mm. This gives a connection between the side tabs 20, 21 which is sufficient for the rest of the folding process, without the shrink-wrapping process for the outer wrapper 13 being initiated as a result of the supply of heat.

Thereafter, folding of those parts of the outer wrapper which project beyond the pack 10 is completed, the end wall 18 and base wall 19 being formed in the process. In order to fix the folding tabs 23, 24, 25, 26, likewise small-surface-area tacking connections produced by heat sealing, namely in each case two tacking strips 29, 30, are provided. These are provided such that all the folding tabs of the end wall 18 and base wall 19 are covered, that is to say are connected to one another locally. This is because the tacking strips 29, 30 are located in a region in which transverse tabs 23 or 24 and the two longitudinal tabs 25, 26 overlap one another in each case.

Following the tacking of the folding tabs 20, 21 and/or 23, 24, 25, 26, said regions are sealed in a conventional manner. This brings about, at the same time, shrinkage of the film of the outer wrapper 13. It is additionally possible, however, for the pack 10 to be subjected to a separate shrink-wrapping process.

Figure 6:
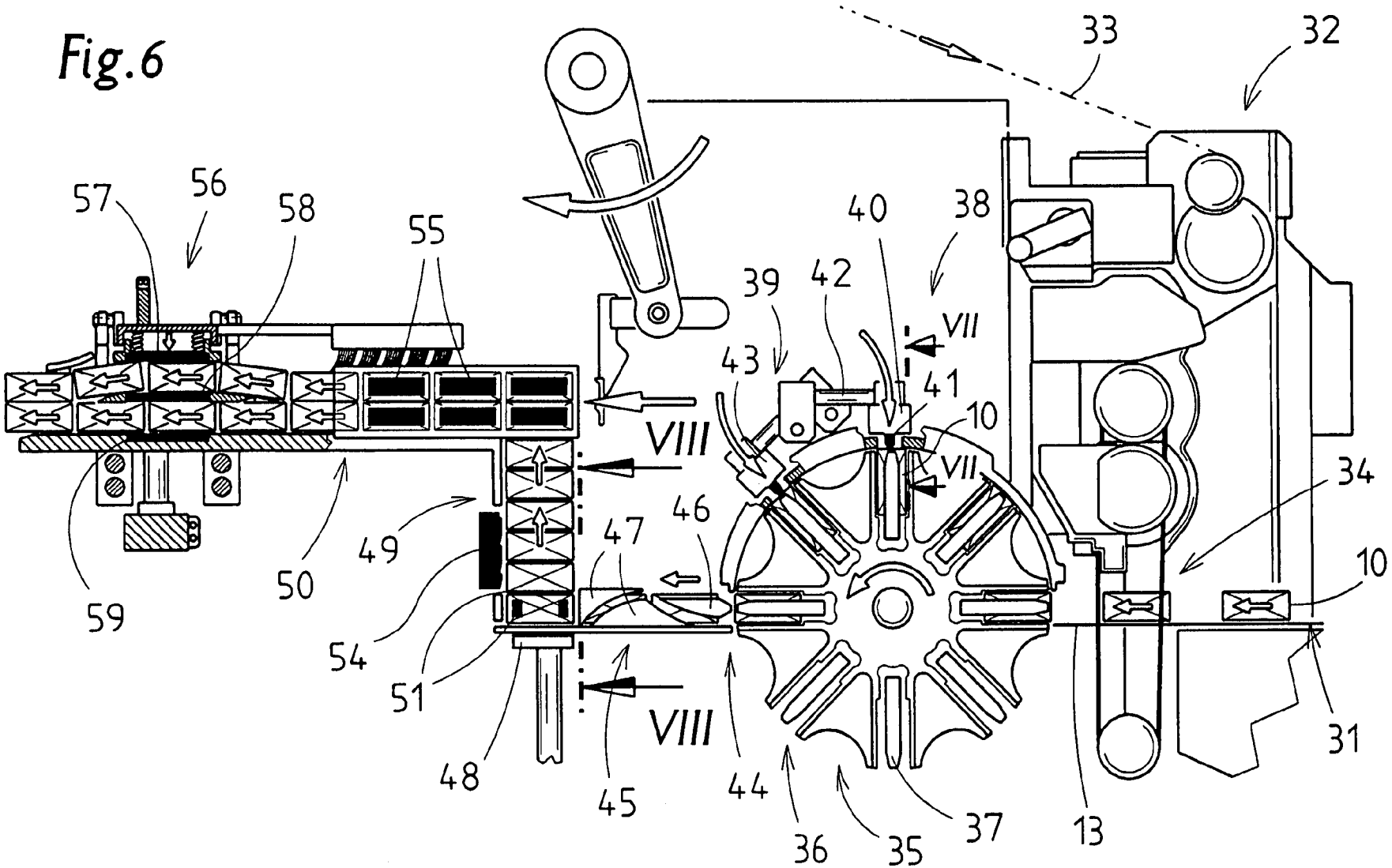
FIG. 6 shows a schematic side view of an apparatus for producing and/or sealing and shrink-wrapping an outer wrapper of a pack.
Figure 7:
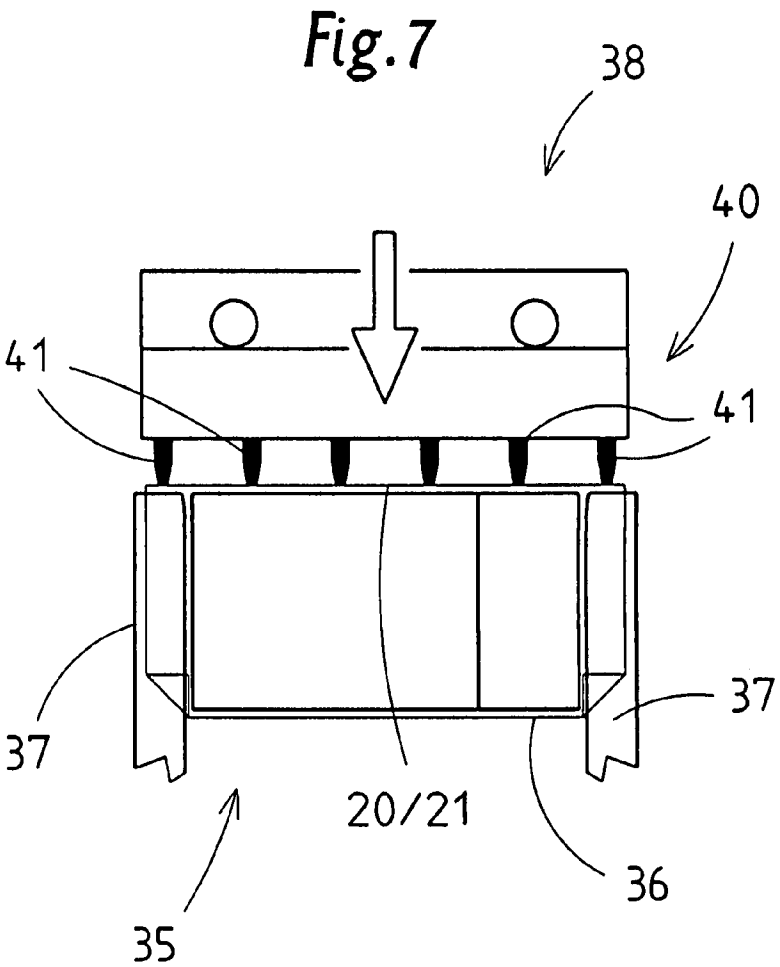
FIG. 7 shows a detail of the apparatus according to FIG. 6, namely a section along section plane VII—VII of a folding turret.
Figure 8:
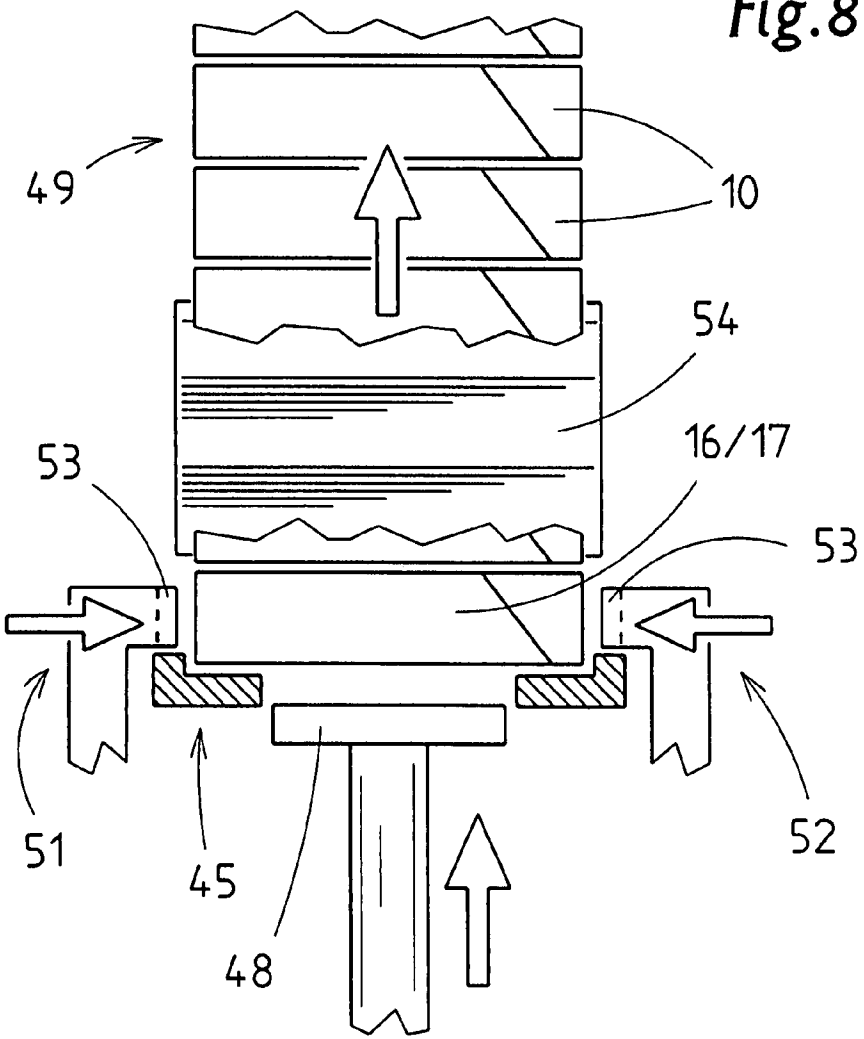
FIG. 8 shows a view of a detail of the apparatus according to FIG. 6 in accordance with arrow VIII.

The operation of providing the tacking connections on the outer wrapper 13 is expediently integrated in the production process of the outer wrapper 13. The apparatus according to FIG. 6 is expediently part of a production line for cigarette packs.

The packs 10, which, with the exception of the outer wrapper 13, have been finished, are supplied on a horizontal pack path 31. The packs 10, which are spaced apart from one another as they arrive, run through a blank unit 32. The latter severs blanks of the outer wrapper 13 from a continuous material web 33. The blanks are held ready in an upright plane, transversely to the pack path 31, by an upright blank conveyor 34, such that the blank of the outer wrapper 13 is folded in the form of a U around the pack 10 conveyed along the pack path 31.

The pack 10 is transferred with the outer wrapper 13 to a folding turret 35. The latter is provided with a plurality of pockets 36, each for receiving one pack 10 with outer wrapper 13, in the present case eight pockets 36 of which in each case two are located in a horizontally directed receiving position and push-out position. The pockets 36 are directed radially and are open on the outside.

When the pack 10 with outer wrapper 13 folded in the form of a U is pushed in, the transverse tabs 24 projecting on both sides of the pack are folded, to be precise, by fixed folding fingers 37 arranged in or on each pocket 36.

By virtue of cyclic rotary movement of the folding turret 35, the packs 10 are conveyed into a first tacking station 38 and then into a second tacking station 39. The first tacking station 38 corresponds to a vertical position of the relevant pocket 36. Upon reaching said first tacking station 38, the side tabs 20, 21 of the outer wrapper 13 have already been folded into a position according to FIGS. 3 and 4. During the standstill phase, in the tacking station 38, a heated tacking element 40 is moved onto the radially outwardly directed side wall 16 of the pack 10. In this case, sealing tools 41 come into abutment against the side tabs 20, 21, to be precise in the region of the overlap 22. The sealing tools 41 are designed in accordance with the tacking which is to be produced, for example as individual protrusions for spot tacking according to FIG. 3 or as a thin, continuous sealing jaw for the exemplary embodiment according to FIG. 4. The tacking element 40 is mounted pivotably on a carrying arm 42.

In the next-following station, the second tacking station 39, the tacking of the side tabs 20, 21 is completed by a correspondingly designed tacking element 43. Two tacking elements and two tacking stations 38, 39 are necessary in particular with short standstill periods of the folding turret 35.

The pack with outer wrapper 13 designed in accordance with FIG. 3 or 4 is pushed radially out of the folding turret 35, and into a folding path 45, in the region of a push-out station 44. In the region of said horizontal folding path 45, those parts of the outer wrapper 13 which project on both sides in the region of the end wall 18 and base wall 19 are folded, that is to say first of all, during the push-out operation, the transverse tab 23 is folded by a fixed folding finger 46 and then the two longitudinal tabs 25 and 26 are folded by corresponding folding elements 47, so-called folding diverters.

Following the folding path 45, the pack 10, with the outer wrapper 14 in the completely folded state, passes onto a platform 48. Form here, the packs 10 are raised cyclically, forming a pack tower 49 in the process, into the region of a horizontal sealing path 50 located at a correspondingly higher level.

Following the folding path 45, namely on the platform 48, the folds of the end wall 18 and base wall 19 are tacked. In order to provide the tacking connections, namely the tacking strips 29, 30, tacking elements 51, 52 are arranged on both sides of the folding path 45 and/or the platform 48, and each have two spaced-apart tacking jaws 52 corresponding to the form of the tacking strips 29, 30. The tacking elements 51, 52 are moved against the end wall 18 and base wall 19 during the standstill phase of the pack 10.

The pack 10, with the outer wrapper 13 now in the completely tacked state, is subjected to a sealing operation in the conventional manner. In this case, first of all sealing of the side tabs 20, 21 is completed by a sealing tool 54, which extends vertically over a plurality of, namely three, packs 10 and seals the side tabs 20, 21 during three standstill phases of the packs 10 in the region of the pack tower 49.

Thereafter, the packs 10 are pushed off transversely into the sealing path 50. Within the latter, the packs 10 are positioned in two rows arranged one above the other. Sealing of the sideways directed end walls 18 and base walls 19 is completed here by sealing jaws 55, likewise during the respective standstill phases of the packs 10 in a number of sealing cycles.

During the sealing of the side tabs 20, 21 and/or of the end walls 18 and base walls 19 in steps which follow one after the other in time, it is possible for the shrink-wrapping operation of the outer wrapper 13 to be initiated or carried out in full. In the exemplary embodiment shown, the packs 10 are conveyed through a separate shrink-wrapping station 56 following the sealing of the outer wrapper 13. In the region of said shrink-wrapping station 56, the packs 10 are subjected to the action of heat in the region of the front wall 14 and/or rear wall 15. For this purpose, heating plates 57, 58, 59 are arranged above, beneath and between the rows of packs 10, said heating plates transmitting the shrink-wrapping heat to the pack 10.

The tacking and sealing temperatures may correspond to one another. A sealing temperature of approximately 145° C. is suitable for tacking the folding tabs 20, 21, 23, 24, 25, 26.

Once it has left the shrink-wrapping station 56, the pack 10 is processed further in a conventional manner.

The above principle of tacking folding tabs of the outer wrapper 13 before the operation of sealing the same may also be advantageous when shrink-wrapping film is not used.

We claim:

1. Process for producing a pack made of thin cardboard with an outer wrapper made of thermally sealable and shrinkable material having folding tabs, including side tabs, and transverse folding tabs and longitudinal folding tabs assigned to an end wall and a base wall of the pack, the outer wrapper enclosing the pack and the folding tabs thereof being connected to one another in the region of overlaps by thermal sealing, comprising the steps of:

(a) providing a blank for forming the outer wrapper and folding said blank around the pack in a tubular shape such that the side tabs of the outer wrapper overlap one another, (b) then connecting the side tabs to one another in the region of the overlap by thermally pre-sealing the side tabs, (c) thereafter folding the transverse and longitudinal folding tabs assigned to the end wall and the base wall such that the transverse folding tabs and the longitudinal folding tabs partially overlap each other, (d) then connecting the transverse and longitudinal folding tabs to one another in the region of their overlap by thermally pre-sealing the overlapping transverse and longitudinal folding tabs, (e) next moving the packs upward into a pack tower, where the side tabs are permanently sealed in the region of their overlap by full-surface sealing, (f) thereafter transporting the pack laterally to a sealing path where the transverse and longitudinal folding tabs are surface sealed, and (g) the packs with the finished and sealed outer wrapper are then conveyed through a shrinking station, in the region of which the large-surface front walls and rear walls of said packs are subjected to a shrinking process for the outer wrapper by means of surface heat transfer.

2. The process of claim 1, wherein the connecting step (b) involves spot seals.

3. The process of claim 1, wherein the connecting steps do not initiate shrink wrapping.

4. The process of claim 1, wherein the connecting step (b) involves tacking.

5. The process of claim 1, wherein the connecting step (b) involves a narrow interrupted sealing strip.

6. The process of claim 1, wherein the connecting step (b) involves a narrow continuous sealing strip.

7. A process for folding and sealing an outer wrapper on a dimensionally stable pack comprising the following steps:

providing a shrink wrapping film for forming the outer wrapper;

wrapping the shrink wrapping film around the pack to form side tabs, bottom tabs, and top tabs;

causing the side tabs to overlap one another;

thermally pre-sealing the side tabs;

causing the bottom tabs to overlap one another and the top tabs to overlap one another;

thermally pre-sealing the overlapping bottom and top tabs; and subsequently thermally permanently sealing the side tabs; and thermally permanently sealing the bottom and top tabs.

8. The method of claim 7, wherein the pre-sealing steps and the permanent sealing steps do not initiate shrink wrapping of the film.

9. The method of claim 7, further comprising the step of shrinking the film, after the side tabs and the bottom and top tabs are permanently sealed, by heating.

10. The method of claim 7, wherein pre-sealing any of the overlapping tabs covers less than half of the area of overlap of the tabs.

* * * * *